US009715984B2

(12) United States Patent
Guo et al.

(10) Patent No.: US 9,715,984 B2
(45) **Date of Patent: *Jul. 25, 2017**

(54) SOLENOID SWITCH AND VEHICLE STARTER

(71) Applicants: Bosch Automotive Products (Changsha) Co., Ltd., Xingsha, Changsha, Hunan (CN); Robert Bosch GmbH, Stuttgart (DE)

(72) Inventors: Jia Guo, Hunan (CN); Jiang Zhao, Hunan (CN); Zebiao Tian, Hunan (CN)

(73) Assignees: Bosch Automotive Products (Changsha) Co., Ltd., Xingsha, Changsha, Hunan (CN); Robert Bosch GmbH, Stuttgart (DE)

( * ) Notice: Subject to any disclaimer, the term of this patent is extended or adjusted under 35 U.S.C. 154(b) by 436 days.

This patent is subject to a terminal disclaimer.

(21) Appl. No.: 14/162,279

(22) Filed: Jan. 23, 2014

(65) Prior Publication Data

US 2014/0202416 A1 Jul. 24, 2014

(30) Foreign Application Priority Data

Jan. 23, 2013 (CN) ..... 2013 1 0024805

(51) Int. Cl.

| | |
|---|---|
| ***F02N 1/00*** | (2006.01) |
| ***H01H 50/02*** | (2006.01) |
| ***F02N 11/08*** | (2006.01) |
| ***H01H 51/06*** | (2006.01) |

(52) U.S. Cl.
CPC ..... *H01H 50/02* (2013.01); *F02N 11/087* (2013.01); *H01H 51/065* (2013.01)

(58) Field of Classification Search
CPC ..... F02N 19/00
USPC ..... 123/179.1; 74/6, 7 B
See application file for complete search history.

(56) References Cited

U.S. PATENT DOCUMENTS

| | | | | |
|---|---|---|---|---|
| 4,116,077 | A * | 9/1978 | Mazzorana | F02N 11/00 74/7 A |
| 2014/0092517 | A1* | 4/2014 | Sora | H01H 50/44 361/160 |
| 2014/0202415 | A1* | 7/2014 | Wang | F02N 11/087 123/179.25 |

* cited by examiner

*Primary Examiner* — John Kwon
(74) *Attorney, Agent, or Firm* — Maginot, Moore & Beck LLP

(57) ABSTRACT

A solenoid switch for a vehicle starter is disclosed, which comprises a housing defining an axial direction; a cap carrying a pair of contact studs, the cap having a front end which is fixed in the housing; a solenoid core mounted in the housing in front of the cap; and an elastic element having a maximum (extreme) allowance compression in the axial direction, the elastic element being compressed between the cap and the solenoid core in the axial direction by an elastic pre-compression amount which is smaller than the maximum allowance compression; wherein the solenoid core is supported by the housing at its front side and is supported by the elastic element at its back side. A vehicle starter comprising such a solenoid switch is also disclosed. Axial bouncing of the cap can be reduced by the invention.

10 Claims, 8 Drawing Sheets

SOLENOID SWITCH AND VEHICLE STARTER

This application claims priority under 35 U.S.C. §119 to patent application no. CN 201310024805.5 filed on Jan. 23, 2013 in China, the disclosure of which is incorporated herein by reference in its entirety.

TECHNICAL FIELD

The invention relates to a solenoid switch used in a vehicle starter and a vehicle starter comprising such a solenoid switch.

BACKGROUND ART

A starter of a motor vehicle generally comprises an electric motor, a transmission mechanism, a control mechanism and the like. In the starting procedure of the vehicle engine, the electric motor generates a rotational torque which is transmitted to a gear ring on a flywheel of the engine via a driving gear of the transmission mechanism to drive a crank shaft of the engine to rotate.

The control mechanism controls the ON/OFF state of a main circuit of the starter, and controls the engagement and disengagement between the driving gear and the gear ring. Nowadays, a solenoid switch is generally used as the control mechanism of the starter. FIG. 1 is a schematic view of the structure of a current solenoid switch of the starter. The solenoid switch mainly comprises a solenoid core 4 and windings 6, all fixedly mounted in a housing 2, two contact studs 10 carried by a cap 8 which is fixed to the housing 2, a solenoid armature 16 axially movable in the inner side of the windings 6, a switching shaft 12 carried by the solenoid core 4 and the solenoid armature 16 in a manner of being axially movable relative to them, an actuating bar 18 fixed to the solenoid armature 16, a striking bar 20 fixed in the solenoid armature 16, a contacting bridge 14 mounted to a back end of the switching shaft 12, etc. The actuating bar 18 is movably connected at its front end with a pinion engaging lever (not shown).

A back end of the solenoid core 4 and a front end of the cap 8 are clamped between a step 22 formed in a back portion of the housing 2 and a crimped inward flange 24 formed by the back end of the housing 2, facing towards each other. A disk spring 21 is disposed between the solenoid core 4 and the cap 8, the disk spring 21 being compressed in the axial direction to a full extent, without any ability of further axial deformation.

When a driver starts the vehicle by an ignition key, an electro-magnetic force is generated in the solenoid armature 16 by the windings 6, under which force the solenoid armature 16 moves backwards towards the solenoid core 4. When the striking bar 20 comes into contact with the switching shaft 12, the striking bar 20 pushes the switching shaft 12 to move axially backwards together with it. The contacting bridge 14 is moved together with the switching shaft 12 until it comes into contact with the two contact studs 10 to electrically connects them, thereby a main circuit of the electric motor is switched on to drive the electric motor to rotate. After the contacting bridge 14 comes into contact with the two contact studs 10 and thus establishes electric connection between the two contact studs 10, the solenoid armature 16 continues to move by a distance towards the solenoid core 4, until it strikes the solenoid core 4 and is stopped by it. During this stage, the front end of the actuating bar 18 pushes the transmission mechanism via the pinion engaging lever, so that the driving gear moves forwards to be engaged with the gear ring on the flywheel of the engine, thereby the engine is started.

In the vehicle starting period, when the solenoid armature 16 strikes the solenoid core 4, an axial striking force thus generated is transmitted from the solenoid core 4 to the crimped portion 24 via the disk spring 21 and the cap 8. The crimped portion 24 may be elastically deformed backwardly and radially outwardly since the thickness of it is relatively small. In this condition, the cap 8 will quickly bounce backwards by a very small distance. Then, as the striking force disappears, the cap 8 gradually comes back to its original position in a vibrated manner. In the short period of the backward bouncing of the cap 8, the contact studs 10 carried by it also bounce backwards quickly, but the contacting bridge 14 cannot completely follow the backward bouncing action of the contact studs 10. Thus, the contacting bridge 14 and the contact studs 10 may be out of contact, which will result in instantaneous break of the main circuit of the electric motor. Such an instantaneous break may cause an instantaneous deep drop of the electric current in the main circuit of the electric motor, which may affect the operation of the electric motor. Meanwhile, an electric arc will be created between the contacting bridge 14 and the contact studs 10. It is known from test that the maximum power of this electric arc may be up to 30 kW, and the heat thus generated may be up to 8 Joule. This energy may result in burning and adhesion between the contacting bridge 14 and the contact studs 10.

SUMMARY OF THE INVENTION

An object of the invention is to solve the problems found in the solenoid switch of the vehicle starter of prior art related with cap bouncing caused by the above mentioned striking as well as thus resulted burning and adhesion between the contacting bridge and the contact studs.

For this end, according to an aspect of the invention, there provides a solenoid switch used in a vehicle starter, which comprises a housing defining an axial direction; a cap carrying a pair of contact studs, the cap having a front end which is fixed in the housing; a solenoid core mounted in the housing in front of the cap; and an elastic element having a maximum (extreme) allowance compression in the axial direction, the elastic element being compressed between the cap and the solenoid core in the axial direction by an elastic pre-compression amount which is smaller than the maximum allowance compression; wherein the solenoid core is supported by the housing at its front side and is supported by the elastic element at its back side.

According to a preferred embodiment of the invention, the elastic element is selected from a group consisted of: a waved spring ring having axial waves in its profile, a disk spring, a coil spring, a composite spring, and a rubber spring.

According to a preferred embodiment of the invention, the housing comprises a substantially cylindrical main body and a first thinner portion having a reduced thickness with respect to the main body, a first retention portion in the form of a step being defined between the main body and the first thinner portion, and the solenoid core being supported at its front side by the first retention portion.

According to a preferred embodiment of the invention, the housing further comprises a second thinner portion having a reduced thickness with respect to the first thinner portion, a second retention portion in the form of a step being defined between the first thinner portion and the second thinner portion, and the cap being clamped in the axial direction between the second retention portion and a radially inwardly crimped portion formed by a back end portion of the housing.

Alternatively, the housing may further comprise a second thinner portion having a reduced thickness with respect to the first thinner portion, and the second thinner portion comprises a deformed portion formed by compression radially inwardly, the cap being clamped in the axial direction between the deformed portion and a radially inwardly crimped portion formed by a back end portion of the housing.

According to a preferred embodiment of the invention, the deformed portion is in the form of a continuous circular recess or a plurality of discrete recessed segments.

According to a preferred embodiment of the invention, the cap and the housing are provided with form fitting features for locating the cap and the housing with respect to each other in a circumferential direction.

According to a preferred embodiment of the invention, the solenoid core and the housing are provided with form fitting features for locating the solenoid core and the housing with respect to each other in a circumferential direction.

According to a preferred embodiment of the invention, the solenoid core is formed with a circular slot on its back side, the elastic element being disposed in the circular slot.

The invention in another aspect provides a vehicle starter which comprises an electric motor; a transmission mechanism coupled with an output shaft of the electric motor; and a solenoid switch described above for controlling the operations of the electric motor and the transmission mechanism.

According to the solenoid switch of the invention, an elastic element, such as a waved spring ring, is compressed between the solenoid core and the cap by an elastic pre-compression amount which is smaller than its maximum allowance compression, that is, not compressed in the axial direction to a full extent, and thus is further axially elastically deformable. Thus, the elastic element obtains an axially damping function by means of this elastic deformation ability. When the solenoid core is subjected to the axial strike of the solenoid armature, the striking force is damped or absorbed by means of the axial elastic deformation ability of the elastic element. Thus, when the solenoid armature strikes the solenoid core, the cap does not noticeably bounce in the axial direction, so that the contacting bridge and the contact studs are not disengaged from each other and the main circuit of the electric motor will not instantaneously break. As a result, the problems found in prior art, including instantaneous deep drop of the electric current in the main circuit of the electric motor and burning and adhesion between the contacting bridge and the contact studs, can be avoided.

DETAILED DESCRIPTION OF PREFERRED EMBODIMENTS

Some preferred embodiments of the invention will be described now with reference to the drawings.

Figure 2:
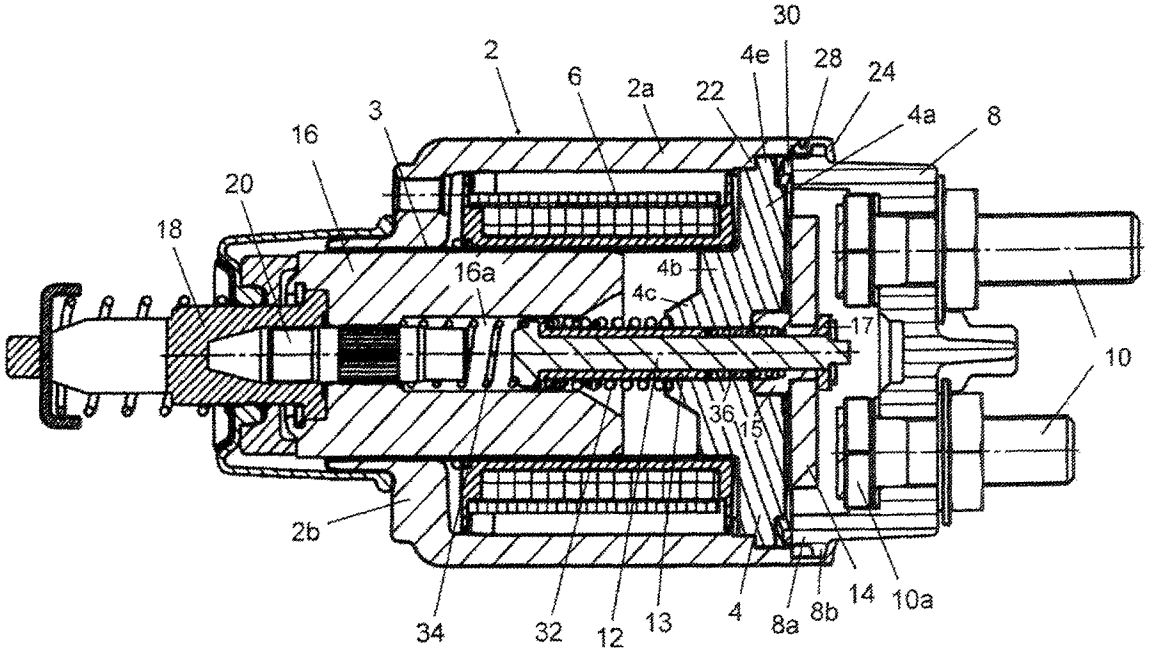
FIG. 2 is a sectional view of a solenoid switch in a vehicle starter according a preferred embodiment of the invention.

FIG. 2 shows a solenoid switch used in a vehicle starter according to an embodiment of the invention.

First, it is noted that, for describing the solenoid switch of the invention, the term "front" or "forward" used here refers to the side proximal to the vehicle engine in the axial direction, and "back" or "backward" refers to the side distal from the vehicle engine in the axial direction.

The solenoid switch comprises a housing 2 which has a main body 2*a* having a substantially cylindrical shape and a front end wall 2*b* provided on a front end (left end in FIG. 2, the end facing towards the vehicle engine) of the main body, the front end wall being formed with a central axial through hole therethrough.

Figure 4:
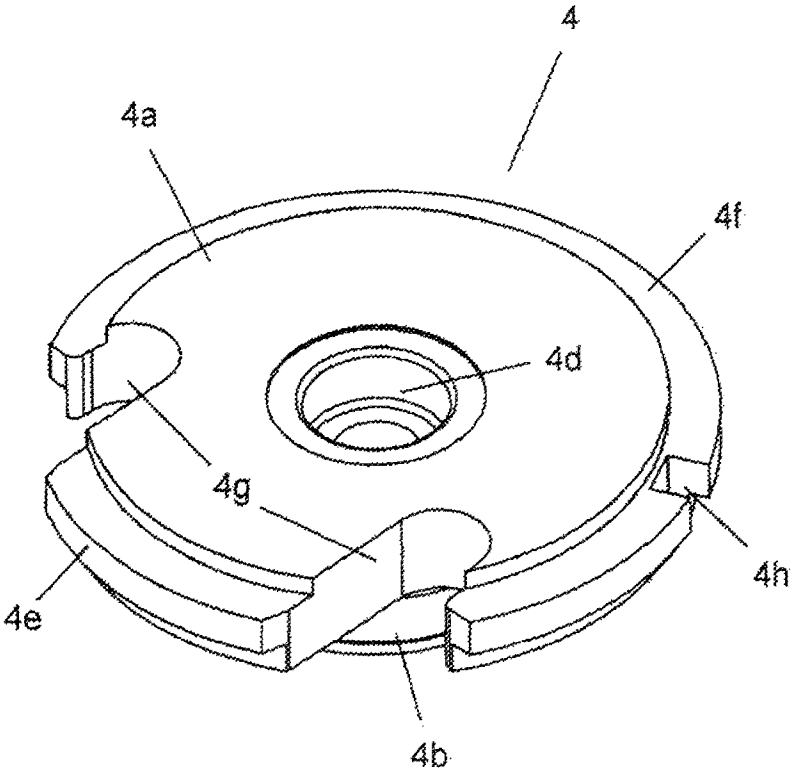
FIG. 4 is a schematic back perspective view of the solenoid core shown in FIG. 3.
Figure 3:
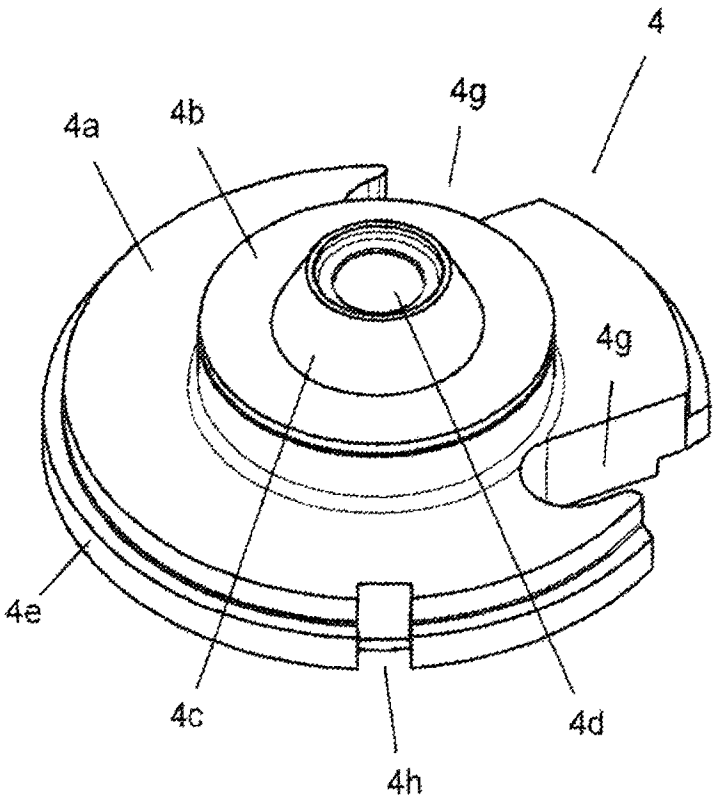
FIG. 3 is a schematic front perspective view of a solenoid core in the solenoid switch shown in FIG. 2.

In a back portion of the main body 2*a* of the housing 2, a solenoid core 4 is fixedly mounted. As shown in FIGS. 2-4 and other figures, the solenoid core 4 comprises a substantially disk shaped larger-diameter portion 4*a*, a substantially cylindrical smaller-diameter portion 4*b* protruded forwards from the larger-diameter portion, and a substantially frusto-conical portion 4*c* protruded forwards from the smaller-diameter portion 4*b*. Further, a guiding hole 4*d* is formed in the axial direction through the solenoid core 4 from its front end to its back end.

Further, a radially outwardly protruded circular flange 4*e* is formed on the outer periphery of the larger-diameter portion 4*a*, and a circular slot 4*f* may be formed in the back end surface of the larger-diameter portion 4*a* along the outer periphery of it.

Further, a pair of axially extended mounting notches 4*g* and an axially extended locating slot 4*h* are formed in the outer periphery of the larger-diameter portion 4*a*.

A substantially cylindrical sleeve 3 of a non-magnetic material (for example, brass) is mounted in the housing 2, wherein the sleeve 3 has a front end inserted in the front end wall 2*b* of the housing 2, and a back end mounted around the smaller-diameter portion 4*b* of the solenoid core 4, and the sleeve 3 is thus fixed in the housing 2. Windings 6 are mounted in a space between the sleeve 3 and the main body of the housing 2, and are supported by the sleeve 3. Leads from the windings 6 extend backwards through the pair of the mounting notches 4*g*.

A solenoid armature 16 is disposed in a substantially front portion of the sleeve 3 in an axially movable manner. The solenoid armature 16 has substantially a cylinder shape.

An actuating bar 18 is fixed to a front end of the solenoid armature 16. The actuating bar extends forwards from its back end which is connected with the front end of the solenoid armature 16, and is operatively coupled at its front end with an upper end of a pinion engaging lever (not shown). The pinion engaging lever is pivotably supported at its substantially middle portion, and is coupled at its lower end with a transmission mechanism. Thus, when the actuating bar 18 moves axially backwards (to the right in FIG. 2), it drives the transmission mechanism to move axially forwards via the pinion engaging lever, so that a driving gear of the transmission mechanism moves towards a gear ring on a flywheel of the engine to come into engagement with it. On the other hand, when the actuating bar 18 moves axially forwards (to the left in FIG. 2), it drives the transmission mechanism to move axially backwards via the pinion engaging lever, so that the driving gear of the transmission mechanism is disengaged from the gear ring on the flywheel of the engine.

A striking bar 20 is fixedly disposed inside the solenoid armature 16. A front portion of the striking bar 20 may be inserted into a back portion of the actuating bar 18 to help the locating and fixing of the actuating bar 18 relative to the solenoid armature 16. A middle portion of the striking bar 20 is fixed to a corresponding portion of the solenoid armature 16. A back portion of the striking bar 20 extends into an axial accommodating bore 16*a* formed in the solenoid armature 16.

A switching shaft 12 is disposed in the accommodating bore 16*a* of the solenoid armature 16 and the guiding hole 4*d* of the solenoid core 4, the switching shaft 12 being axially movable relative to the solenoid armature 16 and the solenoid core 4. A guiding sleeve 13 is carried on the outer periphery of the switching shaft 12, for guiding the switching shaft 12 in the accommodating bore 16*a* and the guiding hole 4*d*, as well as for increasing the gap between the inner periphery wall defining the guiding hole 4*d* and the outer circumference of the switching shaft 12, so that the magnetic gap between the solenoid core 4 and the switching shaft 12 is increased to reduce the interference of the switching shaft 12 to the magnetic circuit generated by the windings 6.

A first return spring 32 is arranged between a front end of the switching shaft 12 and a front end of the solenoid core 4 (the substantially frusto-conical portion 4*c*) for applying a forwardly directed force to the switching shaft 12, so that the switching shaft 12 is kept in its original position, a most forward position, when the solenoid switch is in its rest state.

A second return spring 34 is arranged in the accommodating bore 16*a* between the bottom of the accommodating bore 16*a* and the front end of the switching shaft 12 for applying a forwardly directed force to the solenoid armature 16, so that the solenoid armature 16 is kept in its original position, a most forward position, when the solenoid switch is in its rest state.

A front portion of the switching shaft 12 is disposed in the accommodating bore 16*a* of the solenoid armature 16, a middle portion of the switching shaft 12 extends through the guiding hole 4*d* of the solenoid core 4, and a back end of the switching shaft 12 is exposed from a back end surface of the solenoid core 4.

A contacting bridge 14 is mounted to the back end of the switching shaft 12. In more details, a mount 15 is axially slidably mounted around the back portion of the switching shaft 12, and the contacting bridge 14 is carried by the mount 15.

Further, a third return spring 36 is arranged around the switching shaft 12 between a back end of the guiding sleeve 13 and the mount 15. The contacting bridge 14 which is carried by the mount 15 is movable (slidable) axially forwards on the switching shaft 12 against the pushing force of the third return spring 36, and is also movable backwards until it is stopped by a fastener 17 fixed to the back end of the switching shaft 12.

A cap 8, generally made of plastic, is fixed to a back portion of the housing 2, and two contact studs 10 extend through and are fixed to the cap 8. The two contact studs 10 each have an enlarged front end forming a contacting end 10*a*, front surfaces of the two contacting ends 10*a* facing towards a back surface of the contacting bridge 14. The contact studs 10 each have a front portion fixed in the cap 8 and a back portion exposed from a back surface of the cap 8 and forming a connecting terminal.

Figure 8:
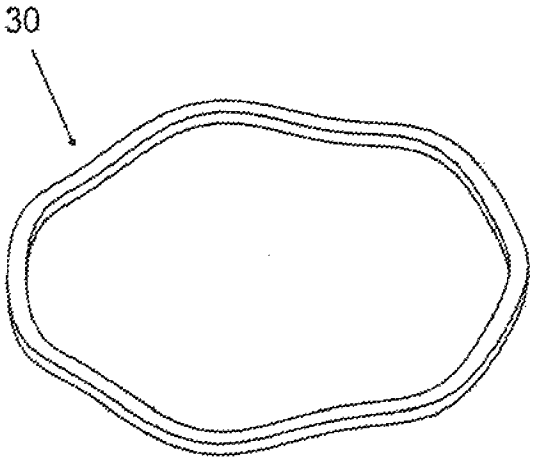
FIG. 8 is a schematic view of a waved spring ring in the solenoid switch shown in FIG. 2.
Figure 9:
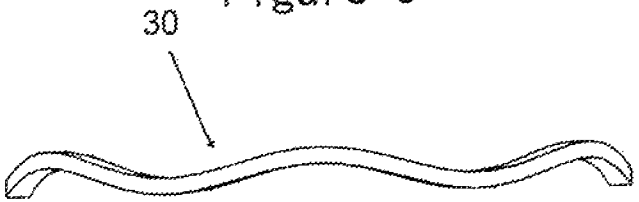
FIG. 9 is an enlarged side view of a segment of the waved spring ring shown in FIG. 8.

As shown in FIG. 2, a back end of the solenoid core 4 (the larger-diameter portion 4*a*) and a front end 8*a* of the cap 8 are clamped in a back end portion of the housing 2, opposing to each other. A waved spring ring 30 is compressed between the solenoid core 4 and the cap 8. As shown in FIGS. 8 and 9, the waved spring ring 30 is circular, having waves in the axial direction in its profile, so that the waved spring ring 30 is axially elastically deformable. The waved spring ring 30 is not compressed in the axial direction to a full extent between the solenoid core 4 and the cap 8, and is thus further axially elastically deformable.

Figure 6:
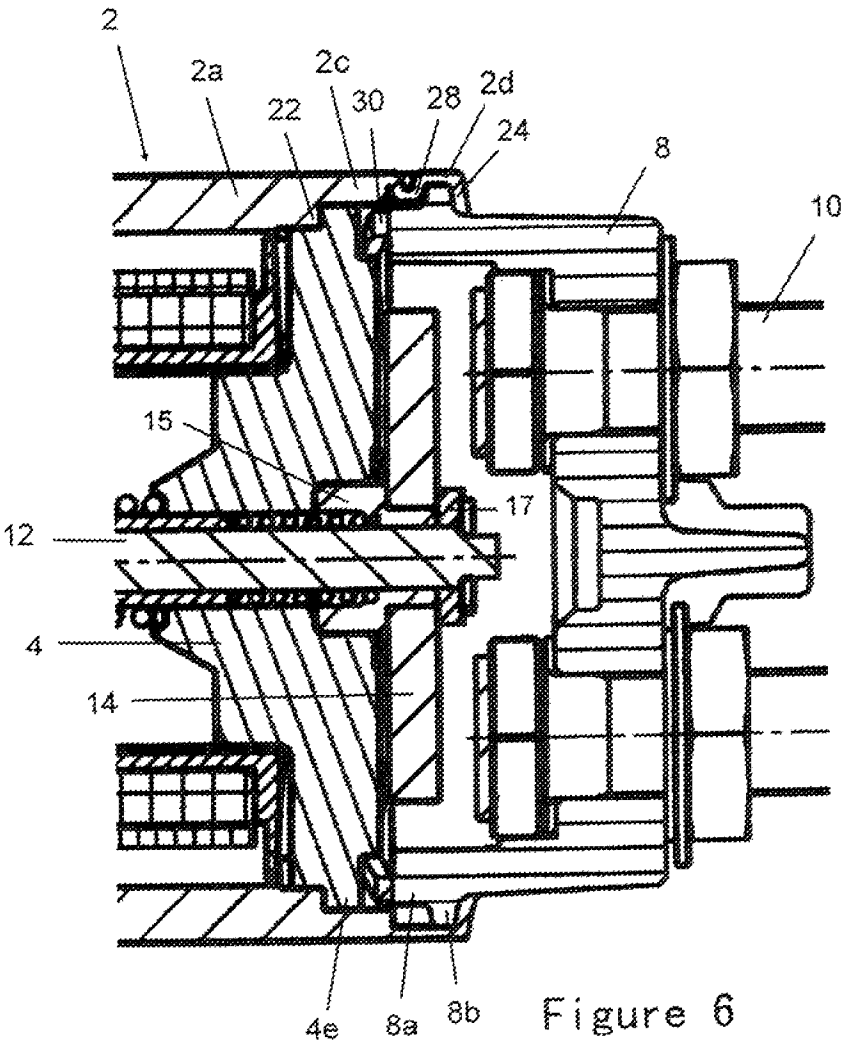
FIGS. 5 and 6 are enlarged sectional views showing respectively the mounting of the solenoid core and a cap to a housing of the solenoid switch shown in FIG. 2.
Figure 5:
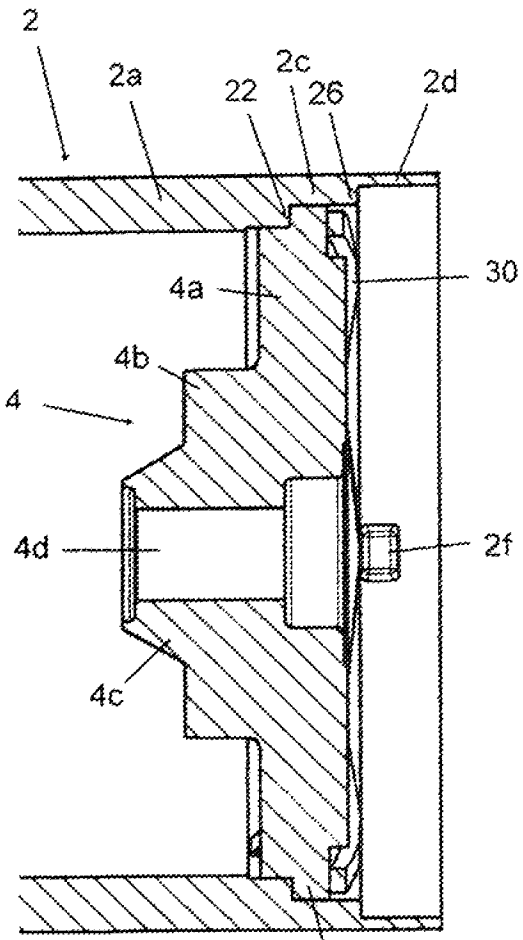
Figure 7:
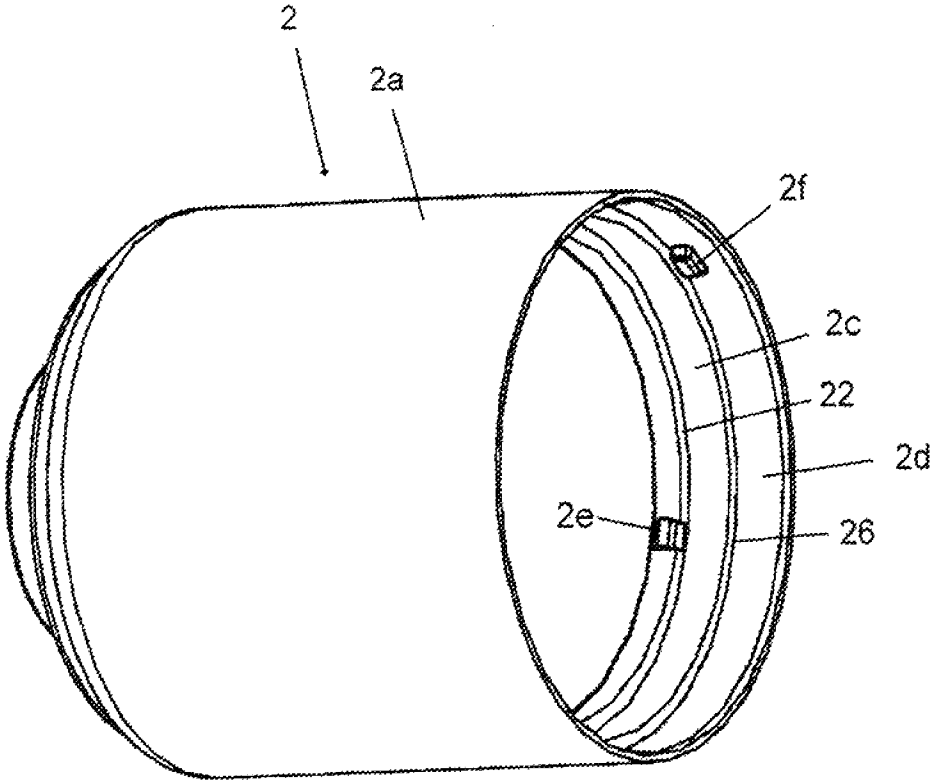
FIG. 7 is a schematic view of the housing of the solenoid switch shown in FIG. 2.

For this end, with reference to FIGS. 5-7, the housing 2 comprises a first thinner portion 2*c* continued with the back end of the substantially cylindrical main body 2*a* with a reduced thickness with respect to the main body 2*a*, and a second thinner portion 2*d* continued with the back end of the first thinner portion 2*c* with a reduced thickness with respect to the first thinner portion 2*c*. Thus, a first backward step (first retention portion) 22 is defined between the main body 2*a* and the first thinner portion 2*c*, and a second backward step (second retention portion) 26 is defined between the first thinner portion 2*c* and the second thinner portion 2*d*.

Further, as shown in FIG. 7, a first locating protrusion 2*e* protrudes radially inwardly from an inner wall of the back end of the main body 2*a* of the housing 2, and a second locating protrusion 2*f* protrudes radially inwardly from an inner wall of the first thinner portion 2*c*.

For mounting the solenoid core 4 and the cap 8 to the housing 2, first, as shown in FIG. 5, the solenoid core 4 is inserted into the housing 2 from the back end of the housing 2, with the frusta-conical portion 4*c* facing forwards, so that the circular flange 4*e* of the solenoid core 4 is located in the first thinner portion 2*c*, with a front surface of the circular flange 4*e* abutting against the first step 22. Now, the first locating protrusion 2*e* of the housing 2 is engaged in the locating slot 4*h* of the solenoid core 4 to locate the solenoid core 4 relative to the circumferential direction of the housing 2, to prevent the solenoid core 4 from rotating around the central axis relative to the housing 2. It is noted in this point that the first locating protrusion 2*e* is not always necessary. Rather, the first locating protrusion 2*e* and the corresponding locating slot 4*h* can be omitted to facilitate assembling, if the waved spring ring 30 has an enough spring force to prevent the solenoid core 4 from rotating relative to the housing 2.

Then, the waved spring ring 30 is put into the housing 2 from the back end of the housing 2 and is positioned in the circular slot 4*f*. It can be understood that the circular slot 4*f* is not always necessary, although it facilitates the locating of the waved spring ring 30.

Then, as shown in FIG. 6, the switching shaft 12 is inserted through the guiding hole 4*d* in the solenoid core 4, and the contacting bridge 14 is mounted to the back end of the switching shaft 12 by means of the mount 15 and the fastener 17.

Then, the front end 8*a* of the cap 8 is mounted into the housing 2, with a front surface of the front end 8*a* abutting against the waved spring ring 30. A circular locating ridge 8*b* protrudes radially outwardly from the outer periphery of the front end 8*a* of the cap 8. Further, a locating slot (not shown) is formed on the outer periphery of the front end 8*a* of the cap 8, the locating slot being recessed radially inwardly and extending axially, and the second locating protrusion 2*f* of the housing 2 is engaged in the locating slot to locate the cap 8 relative to the circumferential direction of the housing 2.

The cap 8 is pushed forwards with a certain axial force, so that the waved spring ring 30 is axially compressed to deform to a certain degree, but the waved spring ring 30 is not compressed in the axial direction to a full extent, and is thus further axially elastically deformable. In this state, a portion of the second thinner portion 2*d* which is axially forward of the locating ridge 8*b* is deformed by compression radially inwardly to form an inwardly deformed portion 28, and a portion (back end portion) of the second thinner portion 2*d* which is axially backward of the locating ridge 8*b* is crimped radially inwardly to form a crimped inward flange 24. In this way, the locating ridge 8*b* is clamped and fixed between the inwardly deformed portion 28 and the crimped inward flange 24.

The inwardly deformed portion 28 may be either in the form of a complete turn of circular recess in the circumferential direction of the second thinner portion 2*d*, or in the form of a plurality of discrete segments in the circumferential direction of the second thinner portion 2*d*. It is appreciated that the inwardly deformed portion 28 may also be formed in the second thinner portion 2*d* before the cap 8 is put into the housing 2.

Alternatively, the inwardly deformed portion 28 may be omitted. In this case, the front end portion of the cap 8, for example, the front surface of the cap 8, abuts against the second step 26 directly.

When all other components of the solenoid switch are assembled in or to the housing 2, the assembling of the solenoid switch shown in FIG. 2 is completed.

Figure 1:
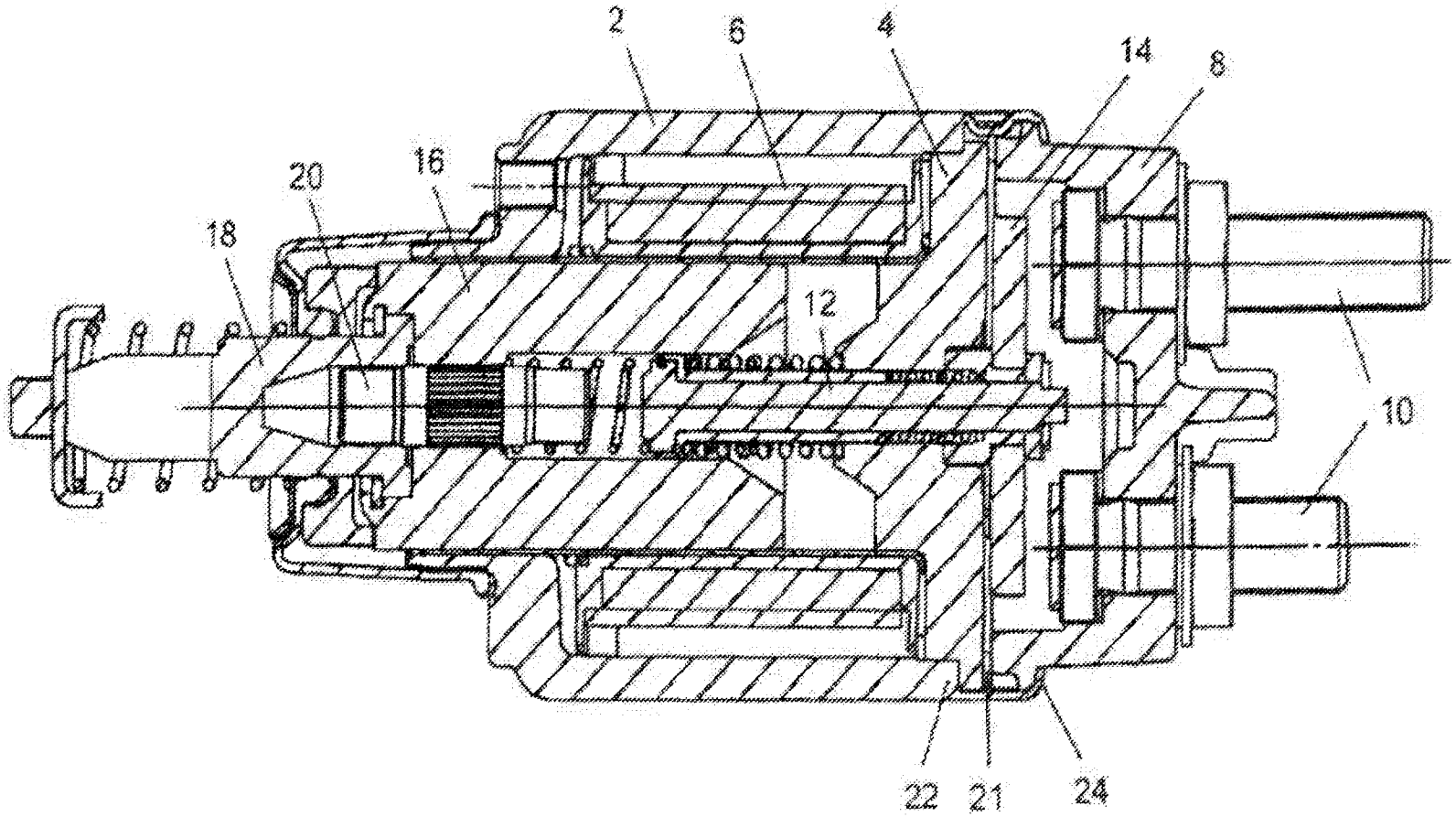
Figure 1 (Prior Art)
FIG. 1 is a sectional view of a solenoid switch in a vehicle starter according to prior art.
Figure 10:
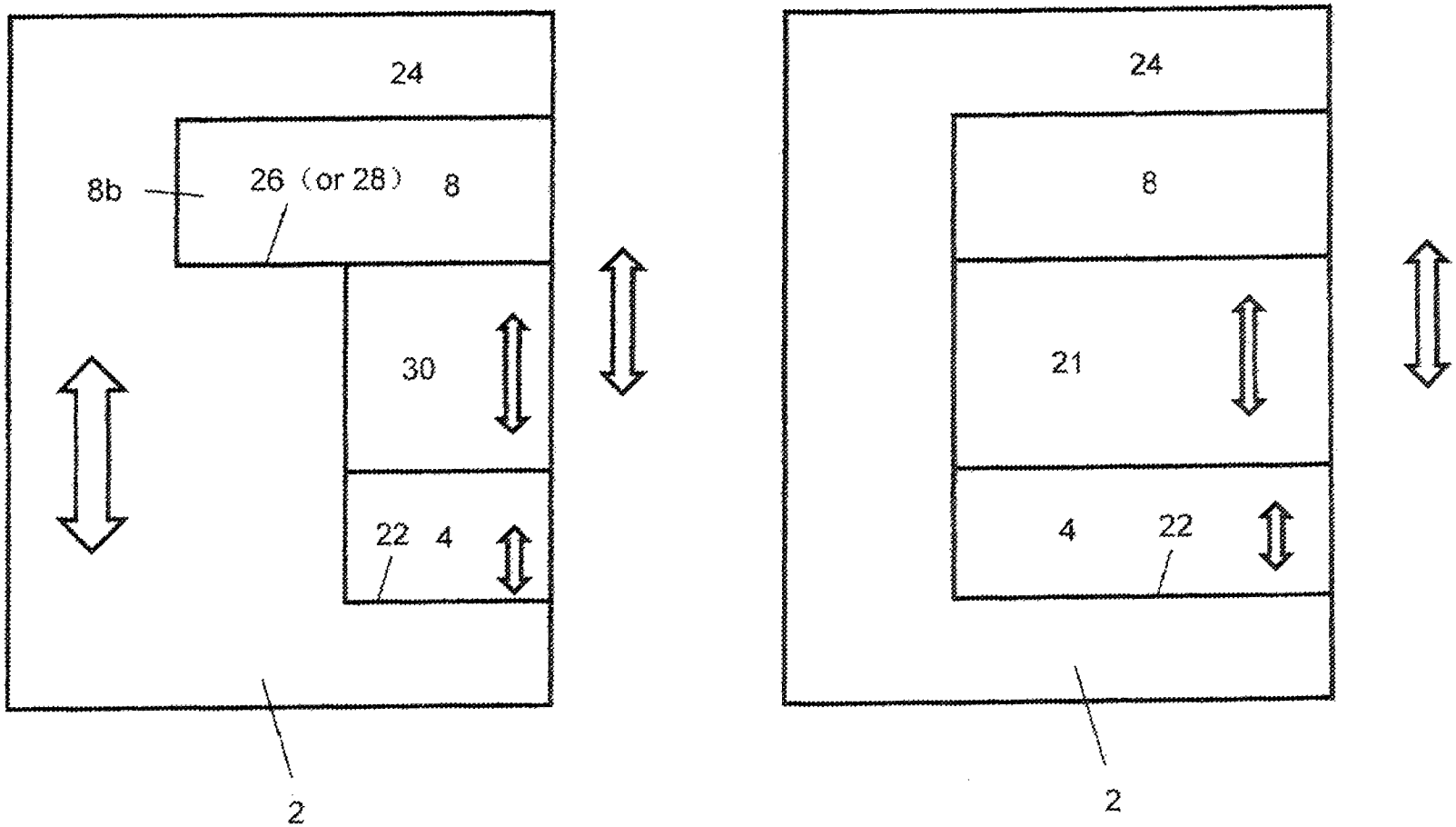
FIG. 10 is a schematic view showing major differences between the solenoid switch of prior art and that of the invention.

Main differences between the structures of the solenoid switch according to the invention as shown in FIG. 2 and the solenoid switch according to prior art as shown in FIG. 1 are indicated schematically in FIG. 10.

Specifically, the right part of FIG. 10 schematically shows the structure at the back end of the housing 2 of the solenoid switch according to prior art as shown in FIG. 1, wherein the cap 8, the disk spring 21 and the solenoid core 4 are clamped between the step 22 of the housing 2 and the crimped inward flange 24 with a certain preloaded axial force, the disk spring 21 is compressed in the axial direction to a full extent between the cap 8 and the solenoid core 4 and has no further axial deformation ability, and thus no axial shock absorption function is provided. When the solenoid core 4 is subjected to an axial strike of the solenoid armature 16, the striking force is transmitted to the crimped inward flange 24 through the disk spring 21 and the cap 8 without damping, which results in large axial deformation of the crimped inward flange 24 and bouncing of the cap 8.

On the contrary, the left part of FIG. 10 schematically shows the structure at the back end of the housing 2 of the solenoid switch according to the invention as shown in FIG. 2, wherein the outer periphery (for example, the locating ridge 8*b*) of the front end of the cap 8 is fixed between the second step 26 (or to the inwardly deformed portion 28) and the crimped inward flange 24. The waved spring ring 30 and the solenoid core 4 are clamped between the front end surface of the cap 8 and the step 22 of the housing 2 with a certain preloaded axial force. The waved spring ring 30 is not compressed in the axial direction to a full extent between the solenoid core 4 and the cap 8, and is thus further axially elastically deformable. The waved spring ring 30 provides an axial shock absorption function by its elastic deformation ability. When the solenoid core 4 is subjected to an axial strike of the solenoid armature 16, the striking force is damped or absorbed by means of the axial elastic deformation of the waved spring ring 30. Then, the reduced striking force is transmitted to the crimped inward flange 24 through the cap 8, so that the axial deformation or bouncing of the crimped inward flange 24 is reduced.

It is appreciated that the waved spring ring 30 can be substituted by other forms of elastic elements, such as disk springs, coil springs, composite springs, rubber springs, etc.

Figure 11:
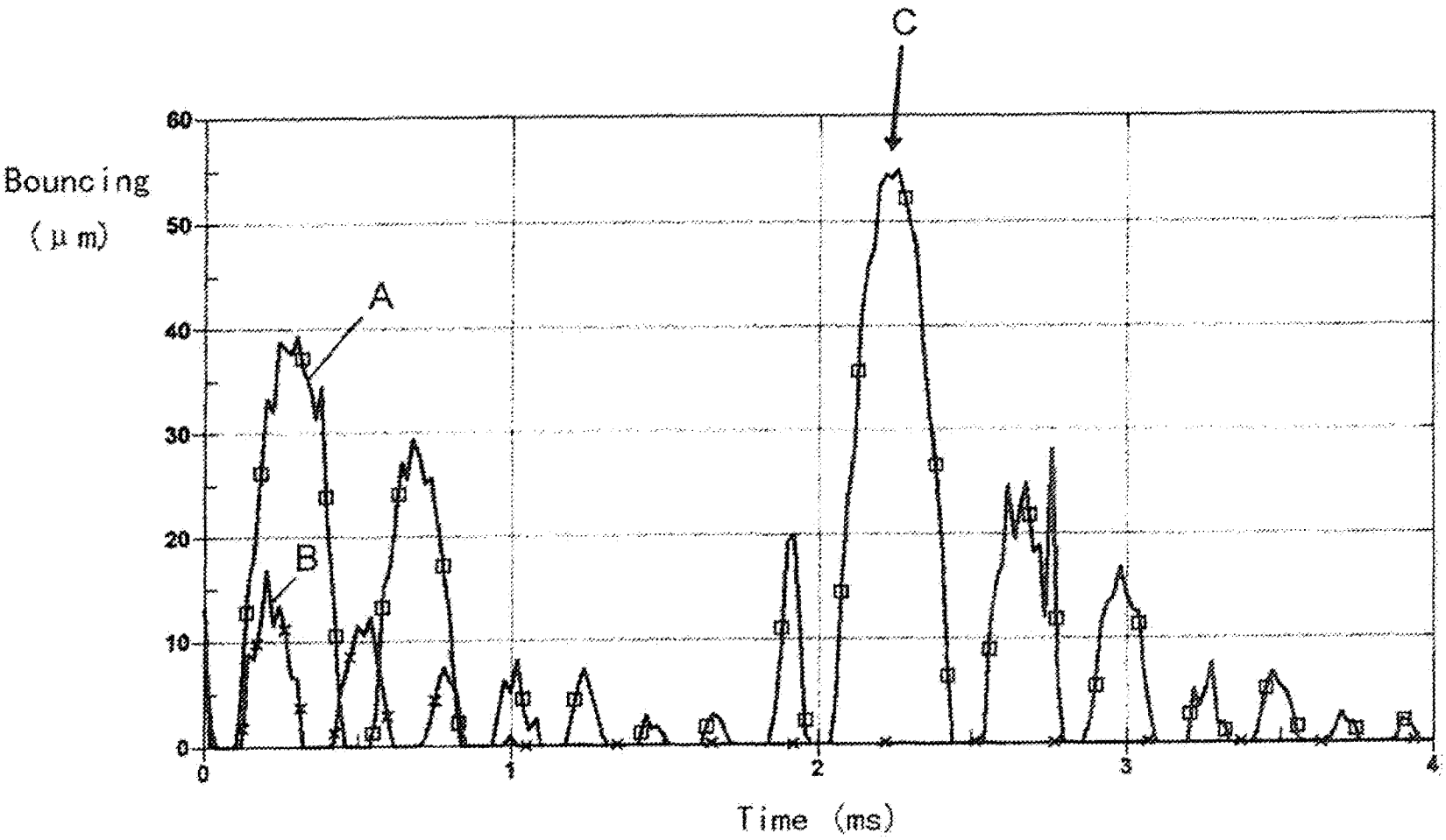
FIG. 11 is a diagram showing imitation results of the cap bouncing in the solenoid switch of prior art and in the solenoid switch of the invention in the starting stage of a vehicle.

FIG. 11 is a diagram showing imitation results of the cap bouncing in the solenoid switch of prior art and in the solenoid switch of the invention in the starting stage of a vehicle, wherein the horizontal axis represents the time passed after a switching-on action of the ignition key, and the vertical axis represents the axial bouncing of the cap. Curve A indicates the bouncing of the cap of the solenoid switch according to prior art as shown in FIG. 1, and Curve B indicates the bouncing of the cap of the solenoid switch according to the invention as shown in FIG. 2. It can be seen that, according to prior art, when the solenoid armature strikes the solenoid core, the cap of the solenoid switch bounces in the axial direction in large amplitudes (with peek point C), while according to the invention, the bouncing of the cap is suppressed when the solenoid armature strikes the solenoid core.

Figure 12:
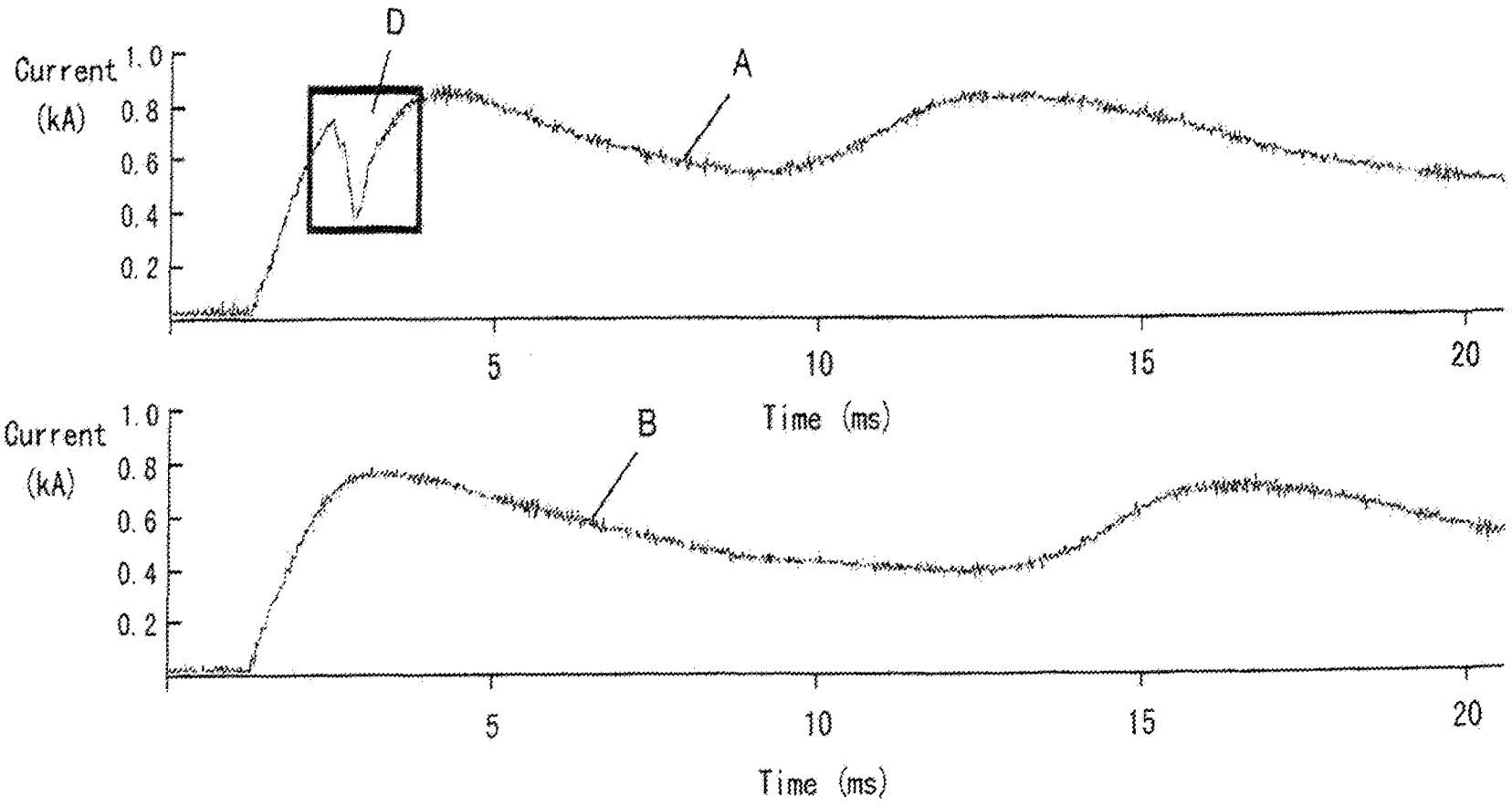
FIG. 12 is a diagram showing test results of electric current flowing in the solenoid switch of prior art and in the solenoid switch of the invention in the starting stage of a vehicle.

FIG. 12 is a diagram showing test results of electric current flowing through the contact studs in the solenoid switch of prior art (Curve A) and in the solenoid switch of the invention (Curve B) in the starting stage of a vehicle.

Results of the test show that, after the ignition key of the vehicle is turned on, in the solenoid switch according to prior art as shown in FIG. 1, the electric current flowing through the contact studs undergoes a deep drop (see the area marked by Block D in FIG. 12) in the rising stage of the electric current corresponding to the peak bouncing caused by the striking of the solenoid armature. On the contrary, in the solenoid switch of the invention, there is no deep drop in the electric current flowing through the contact studs in the rising stage of the electric current.

According to prior art, when the solenoid armature strikes the solenoid core, the dramatic bouncing of the cap may results in disengagement between the contacting bridge and the contact studs, which may cause instantaneous break of the main circuit of the electric motor. The electric current in the main circuit of the electric motor drops deeply instantaneously when such an instantaneous circuit break occurs, which may affect the operation of the electric motor. In addition, electric arc may be generated between the contacting bridge and the contact studs, which may result in burning and adhesion between the contacting bridge and the contact studs.

On the contrary, according to the invention, when the solenoid armature strikes the solenoid core, the cap does not undergoes noticeable bouncing and thus the contacting bridge and the contact studs are not disengaged from each other, and no instantaneous break occurs in the main circuit of the electric motor. As a result, the problems found in prior art, including instantaneous deep drop of the electric current in the main circuit of the electric motor, and burning and adhesion between the contacting bridge and the contact studs, can be avoided.

The invention in another aspect relates to a solenoid switch having a structure described above and a vehicle starter comprising such a solenoid switch.

While certain embodiments of the invention have been described here, they are presented by way of explanation only and are not intended to limit the scope of the invention. Various modifications, substitutions and changes can be made by those skilled in the art within the scope and spirit of the invention as defined in the attached claims and their equivalents.

The invention claimed is:

1. A solenoid switch for a vehicle starter, comprising:

a housing defining an axial direction;

a cap carrying a pair of contact studs, the cap having a front end which is fixed to the housing;

a solenoid core fixedly mounted in the housing in front of the cap; and an elastic element having a maximum allowance compression in the axial direction, the elastic element being positioned in contact with the solenoid core and being compressed against the solenoid core by the cap in the axial direction by an elastic pre-compression amount which is smaller than the maximum allowance compression;

wherein the solenoid core is supported by the housing at its front side and is supported by the elastic element at its back side.

2. The solenoid switch of claim 1, wherein the elastic element is selected from a group consisted of: a waved spring ring having axial waves in its profile, a disk spring, a coil spring, a composite spring, and a rubber spring.

3. The solenoid switch of claim 1, wherein the housing comprises a substantially cylindrical main body and a first thinner portion having a reduced thickness with respect to the main body, a first retention portion in the form of a step being defined between the main body and the first thinner portion, and the solenoid core being supported at its front side by the first retention portion.

4. The solenoid switch of claim 3, wherein the housing further comprises a second thinner portion having a reduced thickness with respect to the first thinner portion, a second retention portion in the form of a step being defined between the first thinner portion and the second thinner portion, and the cap being clamped in the axial direction between the second retention portion and a radially inwardly crimped portion formed by a back end portion of the housing.

5. The solenoid switch of claim 3, wherein the housing further comprises a second thinner portion having a reduced thickness with respect to the first thinner portion, and the second thinner portion comprises a deformed portion formed by compression radially inwardly, the cap being clamped in the axial direction between the deformed portion and a radially inwardly crimped portion formed by a back end portion of the housing.

6. The solenoid switch of claim 5, wherein the deformed portion is in the form of a continuous circular recess or a plurality of discrete recessed segments.

7. The solenoid switch of claim 1, wherein the cap and the housing include form fitting features configured to locate the cap and the housing with respect to each other in a circumferential direction.

8. The solenoid switch of claim 1, wherein the solenoid core and the housing include form fitting features configured to locate the solenoid core and the housing with respect to each other in a circumferential direction.

9. The solenoid switch of claim 1, wherein the solenoid core is formed with a circular slot on its back side, the elastic element being disposed in the circular slot.

10. A vehicle starter, comprising:

an electric motor;

a transmission mechanism coupled with an output shaft of the electric motor; and a solenoid switch configured to control the operations of the electric motor and the transmission mechanism, the solenoid switch including:

a housing defining an axial direction;

a cap carrying a pair of contact studs, the cap having a front end which is fixed in the housing;

a solenoid core fixedly mounted in the housing in front of the cap; and an elastic element having a maximum allowance compression in the axial direction, the elastic element being positioned in contact with the solenoid core and being compressed against the solenoid core by the cap in the axial direction by an elastic pre-compression amount which is smaller than the maximum allowance compression;

wherein the solenoid core is supported by the housing at its front side and is supported by the elastic element at its back side.

* * * * *